US011473854B2

(12) United States Patent
Schwalm

(10) Patent No.: US 11,473,854 B2
(45) Date of Patent: Oct. 18, 2022

(54) HEAT EXCHANGER WITH ADJACENT INLETS AND OUTLETS

(71) Applicant: Hamilton Sundstrand Corporation, Charlotte, NC (US)

(72) Inventor: Gregory K. Schwalm, Avon, CT (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 0 days.

(21) Appl. No.: 16/522,425

(22) Filed: Jul. 25, 2019

(65) Prior Publication Data

US 2019/0346217 A1 Nov. 14, 2019

Related U.S. Application Data

(63) Continuation of application No. 15/003,480, filed on Jan. 21, 2016, now Pat. No. 10,545,001.

(51) Int. Cl.
*F28F 9/02* (2006.01)
*F28D 1/047* (2006.01)
(Continued)

(52) U.S. Cl.
CPC ..... *F28F 9/0268* (2013.01); *F28D 1/0408* (2013.01); *F28D 1/0476* (2013.01);
(Continued)

(58) Field of Classification Search
CPC .. F28F 9/02; F28F 9/026; F28F 9/0265; F28F 9/0268; F28D 1/0408; F28D 1/0476
See application file for complete search history.

(56) References Cited

U.S. PATENT DOCUMENTS 673,767 A * 5/1901 Eycleshymer ..... F28F 9/0268 165/174
1,358,050 A * 11/1920 Paul ..... C01B 17/806 165/174
(Continued)

FOREIGN PATENT DOCUMENTS

DE 8816980 U1 * 8/1991 ..... F28D 1/05391
DE 19644711 A * 4/1998 ..... F26B 11/028
(Continued)

OTHER PUBLICATIONS

Translation of Japanese Patent Document JP 2005315518 A entitled Translation—JP 2005315518 A (Year: 2020).*
(Continued)

*Primary Examiner* — Paul Alvare
(74) *Attorney, Agent, or Firm* — Locke Lord LLP; Scott D. Wofsy; Michael J. Pollack

(57) ABSTRACT

A heat exchange device including a center manifold including flow passages configured to exchange heat between heat exchange fluid within the flow passages and fluid external of the flow passages, wherein adjacent ends of adjacent flow passages each direct fluid flow in opposite directions, at least one separator plate arranged within the center manifold, wherein the inlet and the outlet of each flow passage is separated one of the plurality of separator plates, at least one angled center manifold plate arranged within the center manifold, wherein the angled center manifold plate is angled or curved to alter a static pressure profile throughout the center manifold and make more uniform distribution of flow among channels of the flow passages, wherein a downstream end of the at least one angled center manifold plate abuts an arcuate segment connecting adjacent separator plates.

6 Claims, 5 Drawing Sheets

(51) Int. Cl.
*F28F 9/22* (2006.01)
*F28D 1/04* (2006.01)
*F28D 1/02* (2006.01)

(52) U.S. Cl.
CPC ..... *F28F 9/02* (2013.01); *F28F 9/0246* (2013.01); *F28D 2001/0266* (2013.01); *F28F 2009/224* (2013.01); *F28F 2225/04* (2013.01)

(56) References Cited

U.S. PATENT DOCUMENTS 2,099,186 A * 11/1937 Anderegg ..... F25B 39/028 165/110
4,452,216 A * 6/1984 Patchen, II ..... F02B 29/0462 123/563
4,501,321 A 2/1985 Real et al.
4,693,084 A 9/1987 Ahrens
5,531,266 A * 7/1996 Ragi ..... C07C 2/58 165/110
6,896,043 B2 5/2005 Dunn
7,163,051 B2 * 1/2007 Jibb ..... F28F 9/026 165/110
9,101,079 B2 * 8/2015 Aoki ..... H01L 23/473
9,134,070 B2 * 9/2015 Aoki ..... F28D 1/0476
9,313,919 B2 * 4/2016 Aoki ..... H01L 23/467
9,696,094 B2 * 7/2017 Aoki ..... F28D 1/0476
9,784,504 B2 * 10/2017 Tawa ..... F28F 1/025
9,921,002 B2 * 3/2018 Suzuki ..... H01L 23/473
2006/0067052 A1 * 3/2006 Llapitan ..... F28F 9/0204 361/700
2007/0187080 A1 * 8/2007 Sonoda ..... F28F 9/0246 165/174
2008/0223563 A1 * 9/2008 Penny ..... F02M 26/32 165/166
2011/0132570 A1 * 6/2011 Wilmot ..... F28F 19/006 165/41
2012/0241137 A1 9/2012 Aoki et al.
2013/0201628 A1 8/2013 Aoki et al.

FOREIGN PATENT DOCUMENTS

DE 102008015345 A1 * 9/2009 ..... F28F 9/0268
EP 3492858 A1 * 6/2019 ..... F28F 9/0268
FR 1583744 A * 12/1969 ..... F28F 9/0268
JP 2005315518 A * 11/2005 ..... F28F 21/067
WO WO-2016083480 A1 * 6/2016 ..... F28D 7/1684

OTHER PUBLICATIONS

Translation of German Patent Document DE 8816980 U1 entitled Translation—DE 8816980 U1 (Year: 2020).*
Translation of German Patent Document DE 102008015345 A1 entitled Translation—DE 102008015345 A1 (Year: 2020).*
Translation of German Patent Document DE 19644711 A1 entitled Translation—DE 19644711 A1 (Year: 2020).*
Translation of French Patent Document FR 1583744 A entitled Translation—FR 1583744 A (Year: 2020).*
Translation of Patent Document EP 3492858 A1 entitled Translation—EP 3492858 A1 (Year: 2020).*
Extended European Search Report received from European Patent Office (EPO) dated Jun. 2, 2017 for Application No. EP17150239.6.

* cited by examiner

HEAT EXCHANGER WITH ADJACENT INLETS AND OUTLETS

CROSS-REFERENCE TO RELATED APPLICATIONS

This Application is a Continuation of U.S. application Ser. No. 15/003,480 filed on Jan. 21, 2016, which is incorporated by reference herein in its entirety.

BACKGROUND

1. Field of the Disclosure

The present disclosure relates to heat exchangers, and more particularly to plate-stack heat exchangers.

2. Description of Related Art

Heat exchangers such as, for example, tube-shell heat exchangers, are typically used in aerospace turbine engines. These heat exchangers are used to transfer thermal energy between two fluids without direct contact between the two fluids. In particular, a primary fluid is typically directed through a fluid passageway of the heat exchanger, while a cooling or heating fluid is brought into external contact with the fluid passageway. In this manner, heat may be conducted through walls of the fluid passageway to thereby transfer energy between the two fluids. One typical application of a heat exchanger is related to an engine and involves the cooling of air drawn into the engine and/or exhausted from the engine.

However, typical tube shell design heat exchangers have structural issues when their cantilevered tube bundles are exposed to typical aerospace vibration environments. In addition, there can be significant bypass of flow around the tubes on the low pressure side of the heat exchanger, resulting in reduced thermal effectiveness as well as other adverse system impacts such as excessive low pressure flow. Subsequently, the heat exchangers either fail, or are heavy, expensive, and difficult to manufacture.

Plate stack heat exchangers have been used to address some of the aforementioned issues of tube shell design heat exchangers. Plate stack heat exchangers include layers of heat transfer elements containing hot and cold fluids in flow channels, the layers stacked one atop another in a core A single hot and cold layer are separated, often by a parting sheet, in an assembly referred to as a plate.

Such conventional methods and systems have generally been considered satisfactory for their intended purpose. However, there is still a need in the art for improved heat exchangers. The present disclosure provides a solution for this need.

SUMMARY

A heat exchange device includes a center manifold disposed between a first and second section, each of the first and second sections including flow passages configured for heat exchange between heat exchange fluid within the flow passages and fluid external of the flow passages. Each of the flow passages have a first end and a second end, and wherein adjacent ends of adjacent flow passages direct fluid flow in the same direction.

The first end can include a fluid inlet directing flow from the center manifold through the flow passage and the second end a fluid outlet directing flow from the flow passage to the center manifold. The fluid inlet end and the fluid outlet end of adjacent flow passages can be opposite each other.

A plurality of separators can be positioned within the center manifold configured to separate ends of adjacent flow passages in which fluid flow is in the opposite direction. Each of the separators can be angled or curved to achieve a static pressure profile throughout the manifold resulting in nearly uniform distribution of flow along the width of each flow passage.

Fluid can flow through a first plenum of the center manifold into a fluid inlet of a respective flow passage within the first and second sections and enter the center manifold through a fluid outlet of the respective flow passage. Fluid can exit the center manifold through the second plenum. Each of the first and second sections can include heat exchanger plates in a stacked arrangement. Each of the flow passages can include secondary heat transfer elements within the flow passage and extending from the parting sheets on opposite sides of the flow passage configured to act as heat transfer elements. The secondary heat transfer elements and flow passages can form a solid matrix configured to prevent relative motion within the device and resultant wear.

A heat exchange device includes a center manifold disposed between a first and second section, each of the first and second sections including flow passages configured for heat exchange between heat exchange fluid within the flow passages and fluid external of the flow passages. Each of the flow passages have a fluid inlet and a fluid outlet, wherein fluid inlets of adjacent flow passages are adjacent one another, and wherein fluid outlets of adjacent flow passages are adjacent one another. Each of the flow passages have a first end and a second end, and wherein adjacent ends of adjacent flow passages each direct fluid flow in opposite directions. A plurality of separator plates arranged within the center manifold, wherein the inlet and the outlet of each flow passage is separated one of the plurality of separator plates. The plurality of separator plates are connected to one another by arcuate segments arranged at alternating ends of the separator plates along a height of the manifold section. The inlet and the outlet of adjacent flow passages is separated by one of the plurality of separator plates. A plurality of angled center manifold plates arranged within the center manifold, wherein each of the angled center manifold plates are angled or curved to alter a static pressure profile throughout the center manifold and make more uniform distribution of flow among channels of the flow passages, wherein a downstream end of each angled abuts and arcuate segment connecting adjacent separator plates, and wherein the angled center manifold plates are asymmetrically distributed within the center manifold such that a first group of separator plates are connected by arcuate segments that are abutted by an end of an angled center manifold plate, and a second group of separator plates are connected by arcuate segments that are not abutted by an angled center manifold plate.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE PREFERRED EMBODIMENTS

Figure 1:
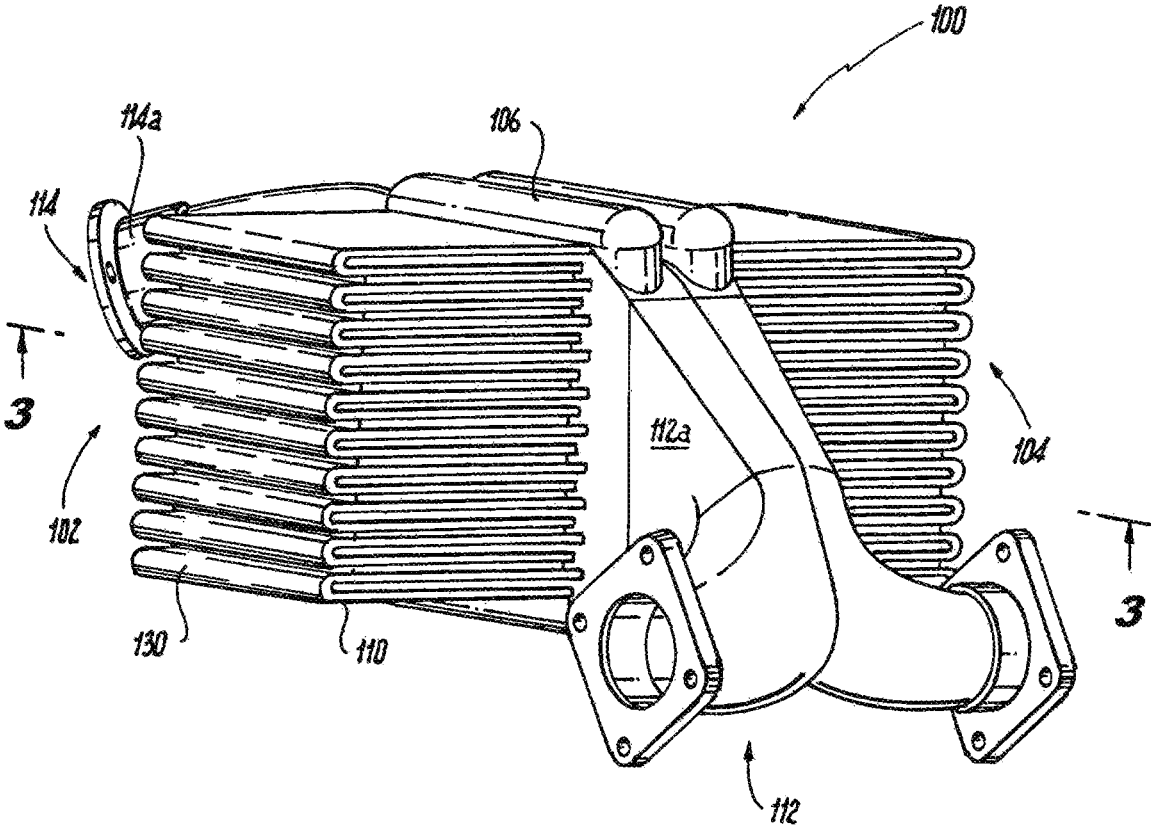
FIG. 1 is a perspective view of a heat exchange device, showing first and second sections and a center manifold.
Figure 2:
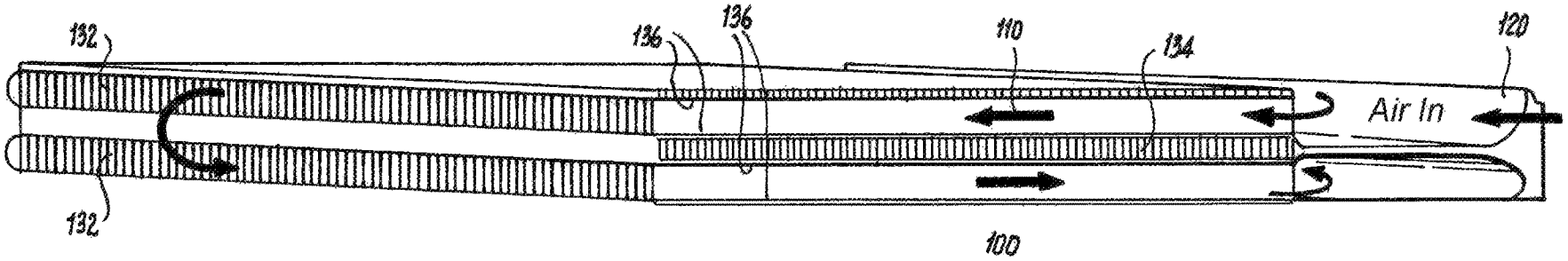
FIG. 2 is a cross-sectional perspective view of a flow passage of each of the first and second sections of FIG. 1, showing a bend at the outer edge of the heat exchange device.

Reference will now be made to the drawings wherein like reference numerals identify similar structural features or aspects of the subject disclosure. For purposes of explanation and illustration, and not limitation, a partial view of an exemplary embodiment of a heat exchange device in accordance with the disclosure is shown in FIG. 1 and is designated generally by reference character 100. Other embodiments of the heat exchange device in accordance with the disclosure, or aspects thereof, are provided in FIGS. 2-5, as will be described. The systems and methods described herein can be used in turbine engines exposed to high pressure and high temperatures, for example in aerospace application.

With reference to FIG. 1, a heat exchange device 100 in accordance with the present disclosure is shown. The device includes a first section 102 and a second section 104. The first and second sections 102, 104 are two identical heat exchanger plate core sections each made up of flow passages 110 configured for heat exchange between heat exchange fluid within the flow passages 110 and fluid external of the fluid passages 110 are separated by parting sheets 136. With continued reference to FIGS. 1 and 2, each of the flow passages 110 includes a bend or loop 130 at the outer edges of the device 100 to return the fluid to the center manifold 106. The bulk of the heat transfer occurs within the flow passages 110 of the first and second sections 102, 104. Secondary heat elements such as fins 132 (see FIG. 2) are included within each of the flow passages 110 and fins 134 extend from the flow passages 110. The fins 132 and 134 act as heat transfer elements and form a solid matrix to provide thermal and structural connection.

Figure 4:
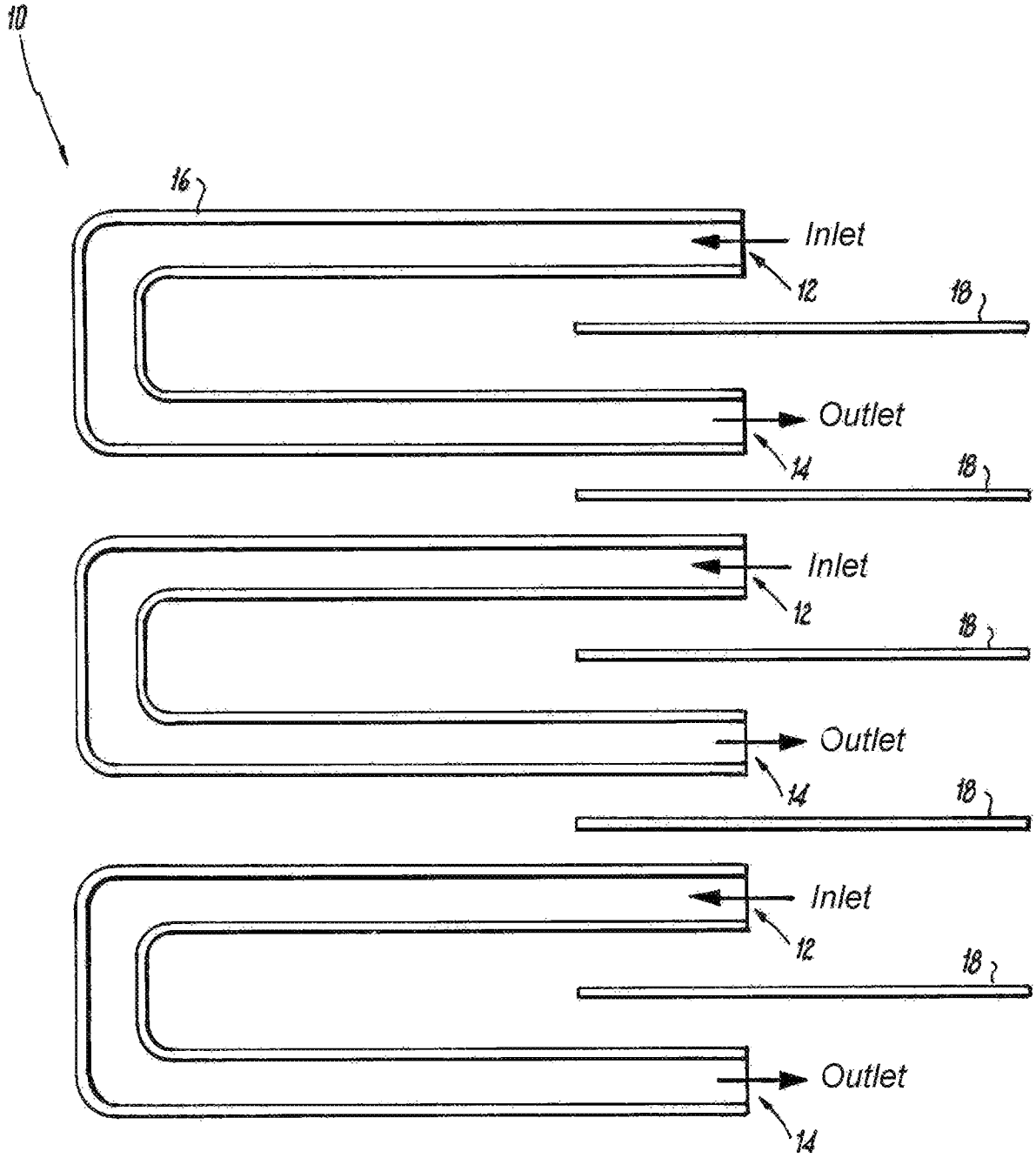
FIG. 4 is a cross-sectional schematic view of one embodiment of the flow directions of heat exchange device of FIG. 1, showing adjacent inlet and outlets directing flow in opposite direction.
Figure 5:
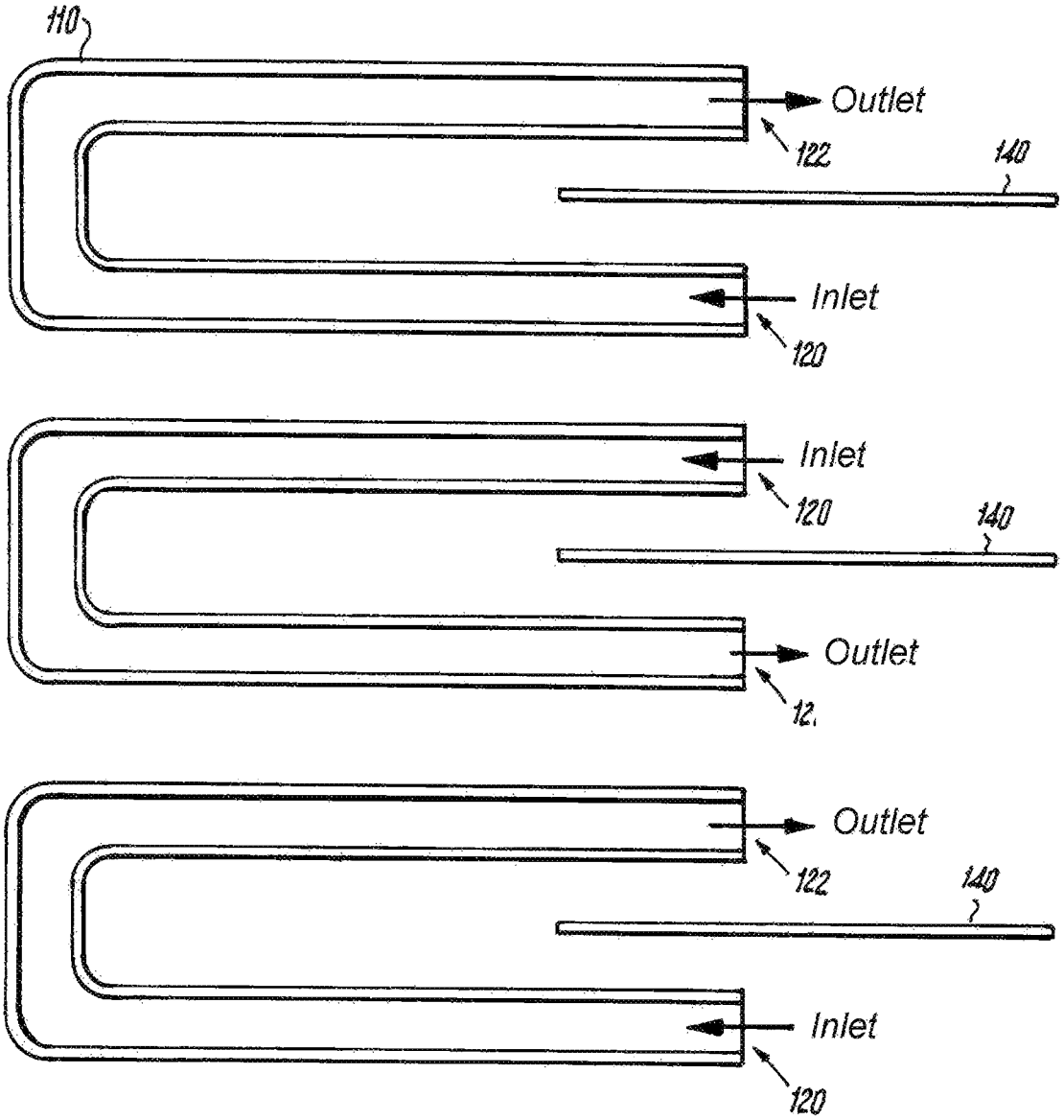
FIG. 5 is a cross-sectional schematic view of an exemplary embodiment of the flow directions of the heat exchange device of FIG. 1, showing adjacent inlet and outlets directing flow in the same direction.

With reference to FIGS. 4 and 5, exemplary embodiments of the flow configuration within flow passages 110 of the present disclosure heat exchange device 100 are shown. FIG. 4 shows one embodiment, in which inlets 12 and outlets 14 alternate along the height of the heat exchanger stack. Separator plates 18 are required to separate each inlet 12 and outlet 14 to separate the inlet and outlet fluid flows. A second embodiment is shown in FIG. 5, in which two inlets 120 and two outlets 122 are adjacent to each other. More specifically, adjacent inlets 120, 122 of adjacent flow passages 110 direct fluid flow in the same direction. The exemplary embodiment shown in FIG. 5 reduces the number of cooling layers in which heat is transferred from inlets 120 to outlets 122 at lower temperature via mixing of cooling flows passing over the parting sheets 136 between the adjacent inlets 120 and outlets 122, and via thermal conduction along cold side fins 134 thereby increasing overall thermal effectiveness of the device, allowing an approximate 10% reduction in weight and volume of the device while meeting a given set of performance requirements. A plurality of separators 140 (shown schematically) are included within the center manifold 106 configured to separate inlets and outlets 122, 120 of flow passages 110 in which fluid flows in the opposite direction. This reduces the number of separators, compared to the embodiment in FIG. 4, to segregate inlet and outlet flows in the manifold, further reducing weight of the device. The separators 140 may be angled or curved to achieve a static pressure profile throughout the manifold resulting in nearly uniform distribution of flow among the channels in each flow passage, with resultant high thermal effectiveness for the device.

The center manifold 106 is configured to allow high pressure fluid to enter the manifold 106 at first side 112, pass into the flow passages 102, 104 on either side of the manifold 106, and return to the manifold 106 to exit the manifold 106 at a second side 114. More specifically, the center manifold 106 includes a first plenum 112*a* at one end and a second plenum 114*a* on an opposing end. Each of the flow passages 106 includes a fluid inlet 120 and a separate fluid outlet 122 (see FIG. 2) leading to and from the center manifold 106, respectively. Fluid flows into the first plenum 114*a* of the center manifold 106, passes through a respective inlet 120 of a flow passage 110, follows a bend/loop 130 of the flow passage 106, enters the center manifold 106 again through the outlet 122 and then exits the center manifold 106 through the second plenum 114*a*. The design for the first and second sections 102, 104 and the center manifold 106 facilitate installation of the proposed heat exchange device 100 in place of an existing tube-shell unit.

Figure 3:
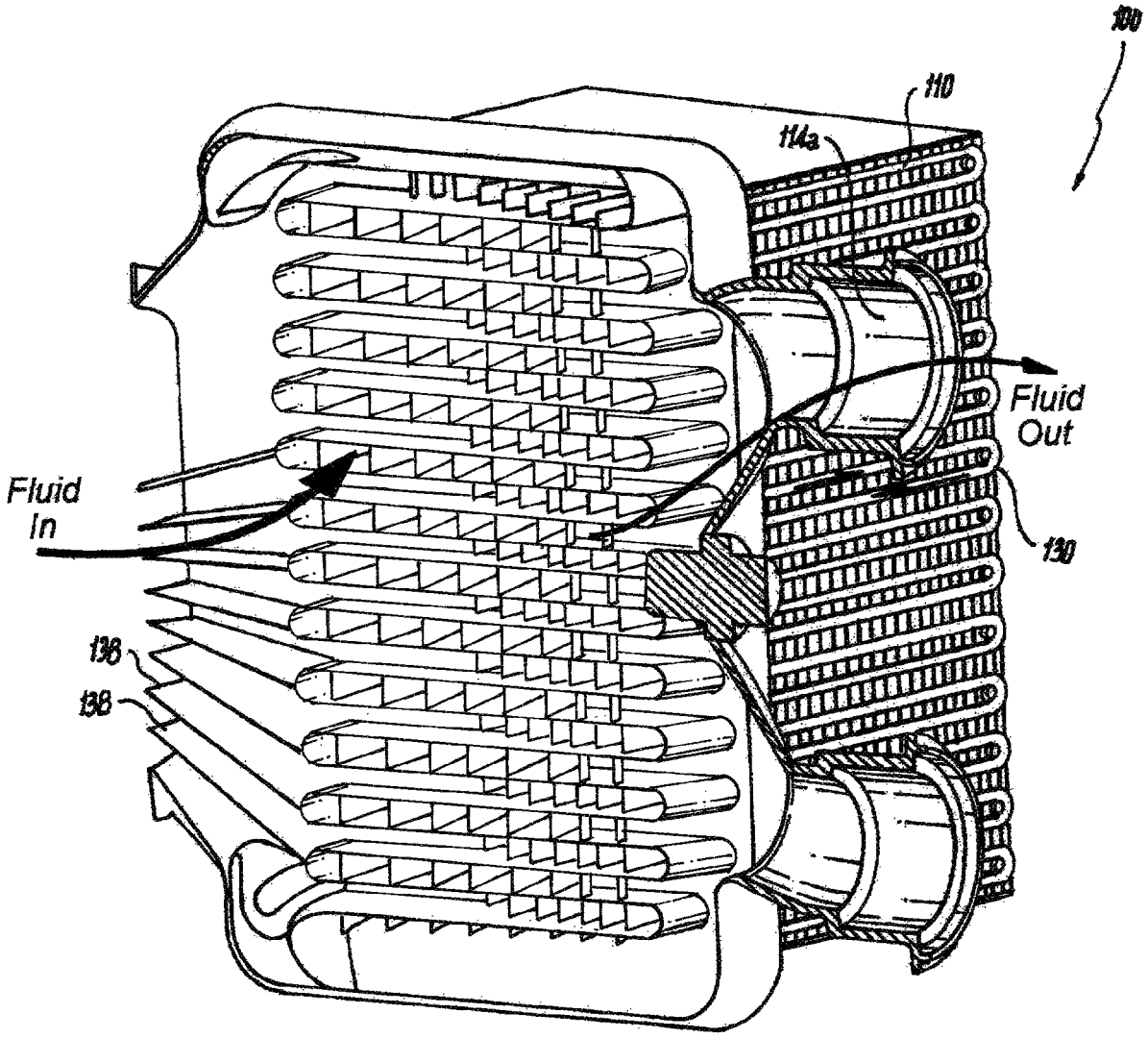
FIG. 3 is a cross-sectional perspective view taken along line 3-3 of the center manifold of FIG. 1, showing the angled center manifold plates.

As shown in FIG. 3, a cross-sectional view of the center manifold 100 illustrating angled center manifold plates 138. The flow rate of hot fluid flowing (illustrated with arrows) within the center manifold 100 varies as a function of a distance along a flow length of the manifold in both the inlet and outlet sections of the center manifold 100. The cross-sectional area increases with increased flow in regions of both the inlet and outlet manifolds to reduce pressure drop as well as to achieve a more uniform static pressure distribution along the flow length of the manifold 100 that helps to achieve more uniform distribution of flow among each flow passage bend 130. This in turn improves the overall thermal effectiveness of the device relative to a manifold configuration with nearly uniform manifold inlet and outlet cross-sectional flow areas.

The methods and systems of the present disclosure, as described above and shown in the drawings, provide for a heat exchange device with superior properties including a directing fluid of adjacent ends of a flow passages in the same direction. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A heat exchange device, comprising:

a center manifold disposed between a first and second section, each of the first and second sections including flow passages configured to exchange heat between heat exchange fluid within the flow passages and fluid external of the flow passages, wherein each of the flow passages have a first end and a second end, and wherein adjacent ends of adjacent flow passages each direct fluid flow in opposite directions, wherein each first end includes a fluid inlet directing flow from the center manifold into each of the flow passages and each second end includes a fluid outlet directing flow from each of the flow passages to the center manifold;

at least one separator plate arranged within the center manifold, wherein the inlet and the outlet of each flow passage is separated by one of the at least one separator plate; and at least one angled center manifold plate arranged within the center manifold, wherein one of the at least one angled center manifold plates is angled or curved to alter a static pressure profile throughout the center manifold and make more uniform distribution of flow among channels of the flow passages, wherein a downstream end of the at least one angled center manifold plate abuts an arcuate segment connecting adjacent separator plates, wherein at least one arcuate segment connecting adjacent separator plates is free of the at least one center manifold plate, and wherein each of the angled separator plates contacts an arcuate segment adjacent to a fluid inlet flow passage, and wherein each of the arcuate segments adjacent to a fluid outlet flow passage is free of the angled separator plates.

2. The heat exchange device of claim 1, wherein the fluid inlet and the fluid outlet of adjacent flow passages are opposite in flow direction of one another.

3. The heat exchange device of claim 1, wherein fluid flows through a first plenum of the center manifold into a fluid inlet of a respective flow passage within the first and second sections, enters the center manifold through a fluid outlet of the respective flow passage, and exits the center manifold through the second plenum.

4. The heat exchange device of claim 1, wherein each of the first and second sections include core sections in a stacked arrangement made up of secondary heat transfer structures attached to parting sheets.

5. The heat exchange device of claim 4, wherein each of the flow passages includes the secondary heat transfer structures within the flow passage and the secondary heat transfer structures extend from each of the flow passages configured to effect heat transfer.

6. The heat exchange device of claim 4, wherein a matrix is formed by a plurality of fins and each of the flow passages configured to limit relative motion within the device and resultant wear.

* * * * *